US005850120A

United States Patent [19]

Okamoto

[11] Patent Number: 5,850,120

[45] Date of Patent: Dec. 15, 1998

[54] ELECTRON GUN WITH A GAMMA CORRECT FIELD EMISSION CATHODE

[75] Inventor: Akihiko Okamoto, Tokyo, Japan

[73] Assignee: NEC Corporation, Tokyo, Japan

[21] Appl. No.: 676,452

[22] Filed: Jul. 8, 1996

[30] Foreign Application Priority Data

Jul. 7, 1995 [JP] Japan ..... 7-196086
Nov. 29, 1995 [JP] Japan ..... 7-310853

[51] Int. Cl.[6] ..... H01J 1/30; H01J 19/24

[52] U.S. Cl. ..... 313/336; 313/309; 313/306; 313/307; 313/496; 315/169.1; 345/74; 345/147

[58] Field of Search ..... 313/309, 336, 313/351, 452, 495, 496, 497, 310, 306, 307, 308; 315/169.1, 169.2; 345/74, 75, 147; 348/675, 674

[56] References Cited

U.S. PATENT DOCUMENTS 5,070,282 12/1991 Epsztein ..... 313/310
5,150,019 9/1992 Thomas et al. ..... 313/309
5,191,217 3/1993 Kane et al. ..... 313/309
5,336,973 8/1994 Leroux et al. ..... 313/452
5,555,000 9/1996 Sarrasin et al. ..... 345/75

*Primary Examiner*—Sandra L. O'Shea
*Assistant Examiner*—Michael Day
*Attorney, Agent, or Firm*—Young & Thompson

[57] ABSTRACT

An electron gun includes a field emission cold cathode (1) having a first electric potential, a primary gate electrode (2) having a first opening around the top of the cathode (1) and having a second electric potential which is higher than the first electric potential for causing an electron emission from the top of the cathode (1), and a second gate electrode (3) having a second opening around the top of the cathode (1) and having a third electric potential which is higher than the first electric potential and lower than the second electric potential, wherein a first voltage defined as a difference between the first and the second electric potentials varies in proportion to a second voltage defined as a difference between the first and the third electric potentials so as to provide a current-voltage characteristic having an apparent gamma-property. The apparent gamma-property is such that the luminous output of a fluorescent substance (7) of an anode (8) is directly proportional to a signal voltage.

24 Claims, 10 Drawing Sheets

ELECTRON GUN WITH A GAMMA CORRECT FIELD EMISSION CATHODE

BACKGROUND OF THE INVENTION

The present invention provides an electron gun provided with a filed emission cold cathode, and more particularly to an improved gate structure of an electron gun provided with a field emission cold cathode for improving a current-voltage characteristic and a convergence property of an electron beam emitted through gate electrodes.

In general, the electron gun is provided with a cathode which is cone-shaped with a top sharp-pointed to generate a field concentration which cause an electron emission from the top of the cathode. Whereas the cathode may also be referred to as an emitter, the term cathode will remain used hereafter. A gate electrode is provided, which has an opening portion surrounding the top of the cathode. The gate electrode is applied a positive voltage to generate a sufficiently strong field around the top of the cathode for causing the electron emission. An anode is provided on an opposite side to the side at which the cathode and the gate are provided so that electrons emitted from the top of the cathode may travel toward the anode.

The above electron gun with the cone-shaped cathode has a current-voltage characteristic given by the following equation which represents a Fowler Nordheim tunneling current.

$$I=A(V^2/\phi)\exp[-B\phi^{3/2}/V]$$

where I is the emission current, V is the voltage applied to the gate electrode, A and B are constant and $\phi$ is the work function.

A high quality display device requires that a ratio of a maximum brightness to a minimum brightness is approximately 1000. In order to obtain such a large contrast of the brightness, the cathode ray tube largely varies a current in the range of a minimum value and a maximum value one thousand times the minimum value whilst the plasma display obtains the high contrast by time sharing.

On the other hand, the conventional cathode ray tube with a thermal cathode has a relationship of gamma-property between a signal voltage and a luminous output which is strongly associated with the emission current. The gamma-property is given by the following equation.

$$L=kE$$

where L is the luminous output, k is constant and is constant and E is the signal voltage.

As described above, the electron gun has the field emission cold cathode which has the current-voltage characteristic represented by the Fowler Nordheim equation, but does not have the gamma-property. For this reason, it is impossible to apply the video signal via an amplifier to the gate electrode. Particularly in the low current range, the different of the Fowler Nordheim current-voltage characteristic from the gamma-property is remarkable. In order to compensate for such difference of the Fowler Nordheim current-voltage characteristic from the gamma-property, it is needed to provide either a circuit for changing the Fowler Nordheim current-voltage characteristic toward the gamma-property or a device for time sharing. This is a certain disadvantage and it is required to settle this problem.

In addition, the electron beam emitted from the top of the cathode travels toward the anode. The electron beam shows spreading at a certain spreading angle. If the spreading angle is excessively large, then electrons hit an inner wall of the tube but do not reach the anode. It is, for example, confirmed that the spreading angle is in the range of 20 degrees and 30 degrees. It has been known in prior art to use a deflecting electrode or a convergence electrode for suppressing the spread of the electron beam. Such manners are, for example, disclosed in Japanese laid-open patent publications Nos. 5-34300, 5-242794, 5-266806 and 7-29484.

In prior art, the deflecting electrode or the convergence electrode is sufficiently spaced apart from the gate electrode. For this reason, if the deflecting electrode or the convergence electrode is provided for arrays of the cathodes, it is unlikely that the electron beams emitted from the cathode positioned in the peripheral region are well converged. It has been required to settle the above problem.

SUMMARY OF THE INVENTION

Accordingly, it is an object of the present invention to provide a novel electron gun with a field emission cold cathode and an improved gate structure wherein a current-voltage characteristic for electron emission is apparent gamma-property.

It is a further object of the present invention to provide an improved gate structure for allowing a current-voltage characteristic for electron emission to be apparent gamma-property in a novel electron gun with a field emission cold cathode.

It is a still further object of the present invention to provide a novel electron gun with a field emission cold cathode and an improved gate structure wherein electrons emitted from the cathode have an approximately minimum ration of the average of a traveling-vertical velocity component to a traveling-parallel velocity component.

It is a further object of the present invention to provide an improved gate structure for allowing electrons emitted from the cathode to have an approximately minimum ratio of the average of a traveling-vertical velocity component to a traveling-parallel velocity component in a novel electron gun with a field emission cold cathode.

The above and other objects, features and advantages of the present invention will be apparent from the following descriptions.

The present invention provides an electron gun and a gate structure of an electron gun having a field emission cold cathode having a first electrical potential. The gate structure comprises the following elements. A primary gate electrode has a first opening portion surrounding the top of the cathode. The primary gate electrode has a second electrical potential which is higher than the first electrical potential for causing an electron emission from the top of the cathode. At least a secondary gate electrode has a second opening portion and is spaced apart from the primary gate electrode in a direction parallel to a traveling direction along which electrons emitted from the top of the cathode travel. The secondary gate electrode has a third electrical potential which is higher than the first electrical potential and lower than the second electrical potential so as to provide a current-voltage characteristic which suppresses the electron emission particularly in a low current region.

The present invention also provides another gate structure of an electron gun having a field emission cold cathode having a first electrical potential. The gate structure comprises the following elements. A primary gate electrode has a first opening portion surrounding the top of the cathode. The primary gate electrode has a second electrical potential which is higher than the first electrical potential for causing an electron emission from the top of the cathode. A secondary gate electrode has a second opening portion surrounding the primary gate electrode. The secondary gate electrode is spaced apart from the primary gate electrode in a direction vertical to a traveling direction along which electrons emitted from the top of the cathode travel. The secondary gate electrode has a third electrical potential which is higher than the first electrical potential and lower than the second electrical potential so as to provide a current-voltage characteristic which suppresses the electron emission particularly in a low current region.

The present invention further provides still another gate structure of an electron gun having a field emission cold cathode having a first electrical potential. The gate structure comprises the following elements. A primary gate electrode has a first opening portion surrounding the top of the cathode. The primary gate electrode has a second electrical potential which is higher than the first electrical potential for causing an electron emission from the top of the cathode. At least a secondary gate electrode has a second opening portion and is spaced apart from the primary gate electrode in a direction parallel to a traveling direction along which electrons emitted from the top of the cathode travel. The secondary gate electrode has a third electrical potential which is lower than the first electrical potential for reduction in a vertical velocity component of electrons emitted from the cathode in a direction vertical to the traveling direction. A ternary gate electrode has a third opening portion and is spaced apart from the secondary gate electrode in a direction parallel to the traveling direction. The ternary gate electrode has a fourth electrical potential which is higher than the first electrical potential for acceleration in a parallel velocity component of the electrons emitted from the cathode in a direction parallel to the traveling direction so that, in cooperation with the secondary gate electrode, the ternary gate electrode provides an electric field which causes the electrons emitted from the cathode to have an approximately minimum ratio of the average of the vertical velocity component to the parallel velocity component.

BRIEF DESCRIPTIONS OF THE DRAWINGS

Preferred embodiments of the present invention will be described in detail with reference to the accompanying drawings.

DESCRIPTION OF THE PREFERRED EMBODIMENTS

Figure 1:
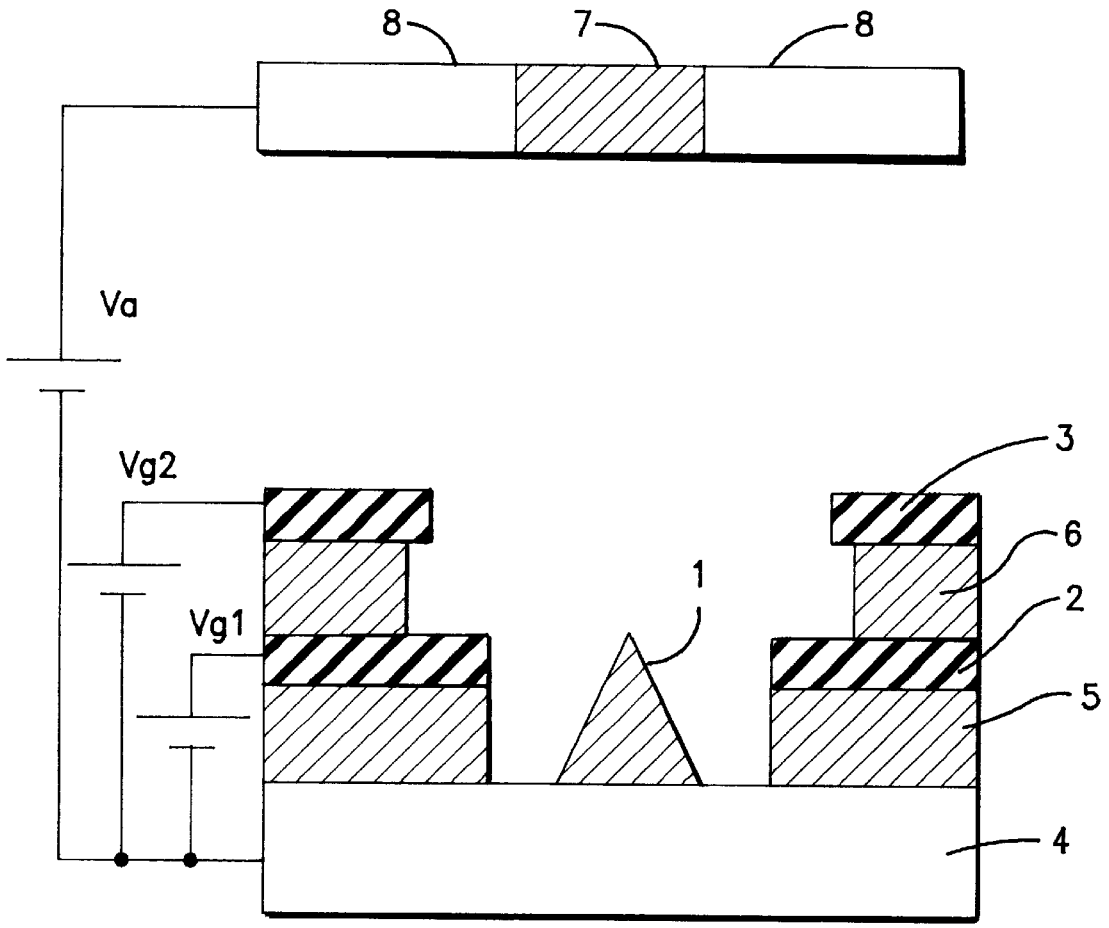
FIG. 1 is a cross sectional elevation view illustrative of a novel electron gun with a field emission cold cathode and an improved gate structure in a first embodiment according to the present invention.

The present invention provides an electron gun and a gate structure of an electron gun having a field emission cold cathode having a first electrical potential. The gate structure comprises the following elements. A primary gate electrode has a first opening portion surrounding the top of the cathode. The primary gate electrode has a second electrical potential which is higher than the first electrical potential for causing an electron emission from the top of the cathode. At least a secondary gate electrode has a second opening portion and is spaced apart from the primary gate electrode in a direction parallel to a traveling direction along which electrons having emitted from the top of the cathode travel. The secondary gate electrode has a third electrical potential which is higher than the first electrical potential and lower than the second electrical potential so as to provide a current-voltage characteristic which suppresses the electron emission particularly in a low current region.

A first voltage defined as a difference between the first and second electrical potentials may vary in proportion to a second voltage defined as a difference between the first and third electrical potentials so that the current-voltage characteristic is kept to have an apparent gamma-property.

Alternatively, the first, second and third electrical potentials may be determined on the basis of a height of the cathode and a distance between the primary and secondary gate electrodes along the parallel directions as well as first and second sizes of the first and second opening portions of the primary and secondary gate electrodes respectively so that the current-voltage characteristic is kept to have an apparent gamma-property. In this case, it is available that the first size of the first opening portion of the primary gate electrode is larger than the second size of the second opening portion of the secondary gate electrode.

The primary and secondary gate electrodes may be separated by an insulation film.

Alternatively, the primary and secondary gate electrodes may be separated by space.

It is preferable that the cathode has a cone shape with a top pointed.

A ternary gate electrode having a third opening portion may surround the primary gate electrode. The ternary gate electrode is spaced apart from the primary gate electrode in a direction vertical to the traveling direction. The ternary gate electrode has a fourth electrical potential which is higher than the first electrical potential and lower than the second electrical potential so as to provide, in cooperation with the secondary gate electrode, a current-voltage characteristic which suppresses the electron emission particularly in a low current region.

As described above, the secondary gate electrode, having the third electrical potential which is higher than the first electrical potential and lower than the second electrical potential, provides a current-voltage characteristic which suppresses the electron emission particularly in a low current region, preferably provides an apparent gamma-property. The first, second and third electrical potentials are determined on the basis of a height of the cathode and a distance between the primary and secondary gate electrodes along the parallel direction as well as first and second sizes of the first and second opening portions of the primary and secondary gate electrodes respectively so that the current-voltage characteristic is kept to have the apparent gamma-property like thermal cathode. The voltage between the cathode and the secondary gate electrode is preferably set to be proportional to the voltage between the cathode and the primary gate electrode. This makes it possible to apply a video signal having the gamma-property directly onto the gate electrode or emitter without use of any other circuits or device such as time division controller or property conversion circuits. This facilitates a simplification of the circuit configuration and structure of the electron gun as well as a driving of the electron gun under precise control.

The present invention also provides another gate structure of an electron gun having a field emission cold cathode having a first electrical potential. In this gate structure the secondary gate electrode is spaced apart from the primary gate electrode in a direction vertical to a traveling direction along which electrons having emitted from the top of the cathode travel.

The present invention further provides still another gate structure of an electron gun having a field emission cold cathode having a first electrical potential. The gate structure further includes a ternary gate electrode that has a third opening portion and is spaced apart from the secondary gate electrode in a direction parallel to the traveling direction. The ternary gate electrode has a fourth electrical potential which is higher than the first electrical potential for acceleration in a parallel velocity component of the electrons having emitted from the cathode in a direction parallel to the traveling direction so that, in cooperation with the secondary gate electrode, the ternary gate electrode provides an electrical field which causes the electrons emitted from the cathode to have an approximately minimum ratio if the average of the vertical velocity component to the parallel velocity component.

A quaternary gate electrode having a fourth opening portion may surround the primary gate electrode. The quaternary gate electrode is spaced apart from the primary gate electrode in a direction vertical to the traveling direction. The ternary gate electrode has a fifth electrical potential which is higher than the first electrical potential for further acceleration in a parallel velocity component of the electrons having emitted from the cathode in a direction parallel to the traveling direction so that, in cooperation with the secondary and ternary gate electrodes. The quaternary gate electrode provides an electric field which causes that the electrons emitted from the cathode to have an approximately minimum ratio of the average of the vertical component to the parallel velocity component.

A first embodiment according to the present invention will be described with reference to FIG. 1. A cathode 1 is provided on a substrate 4, which has a cone shape with a top sharp-pointed. A first insulation film 5 is provided on the substrate 4 and has an opening portion which surrounds the cathode 1. The first insulation film 5 has a circular-shaped opening portion which surrounds the cone-shaped cathode 1 via a gap. The thickness of the first insulation film 5 is smaller than a height of the cone-shaped cathode 1. A primary gate electrode 2 made of a metal is formed on the first insulation film 5. The primary gate electrode 2 has the opening portion which surrounds of the cone-shaped cathode 1. A second insulation film 6 is provided on the primary gate electrode 2. A secondary gate electrode 3 is provided on the second insulation film 6 so that the secondary gate electrode 3 is electrically separated from the primary gate electrode 2.

An anode electrode 8 in combination with a fluorescent substance 7 is provided over the secondary gate electrode 3 via a large distance therefrom.

A voltage Va is applied between the anode and the cathode 1. A voltage Vg1 is applied between the primary gate electrode 2 and the cathode 1. A voltage Vg2 is applied between the secondary gate electrode 3 and the cathode 1. The voltage Vg1 applied to the primary gate electrode 2 is set to cause an electron emission from the sharp-pointed top of the cone-shaped cathode 1. The voltage Vg2 applied to the secondary gate electrode 3 is lower than the voltage Vg1 applied to the primary gate electrode 2 and set to cause electrons emitted from the cone-shaped cathode 1 once to reduce velocity in passing through the secondary gate electrode 3 and to suppress the electron emission when the amount of the electron emission is small. The voltage Va applied to the anode is larger than the voltage Vg2 applied to the secondary gate electrode 3 and set to cause electrons having passed through the secondary gate electrode 3 to accelerate toward the anode 8 so that accelerated electrons hit the fluorescent substance 7 whereby the fluorescent substance 7 generates fluorescence.

Figure 2:
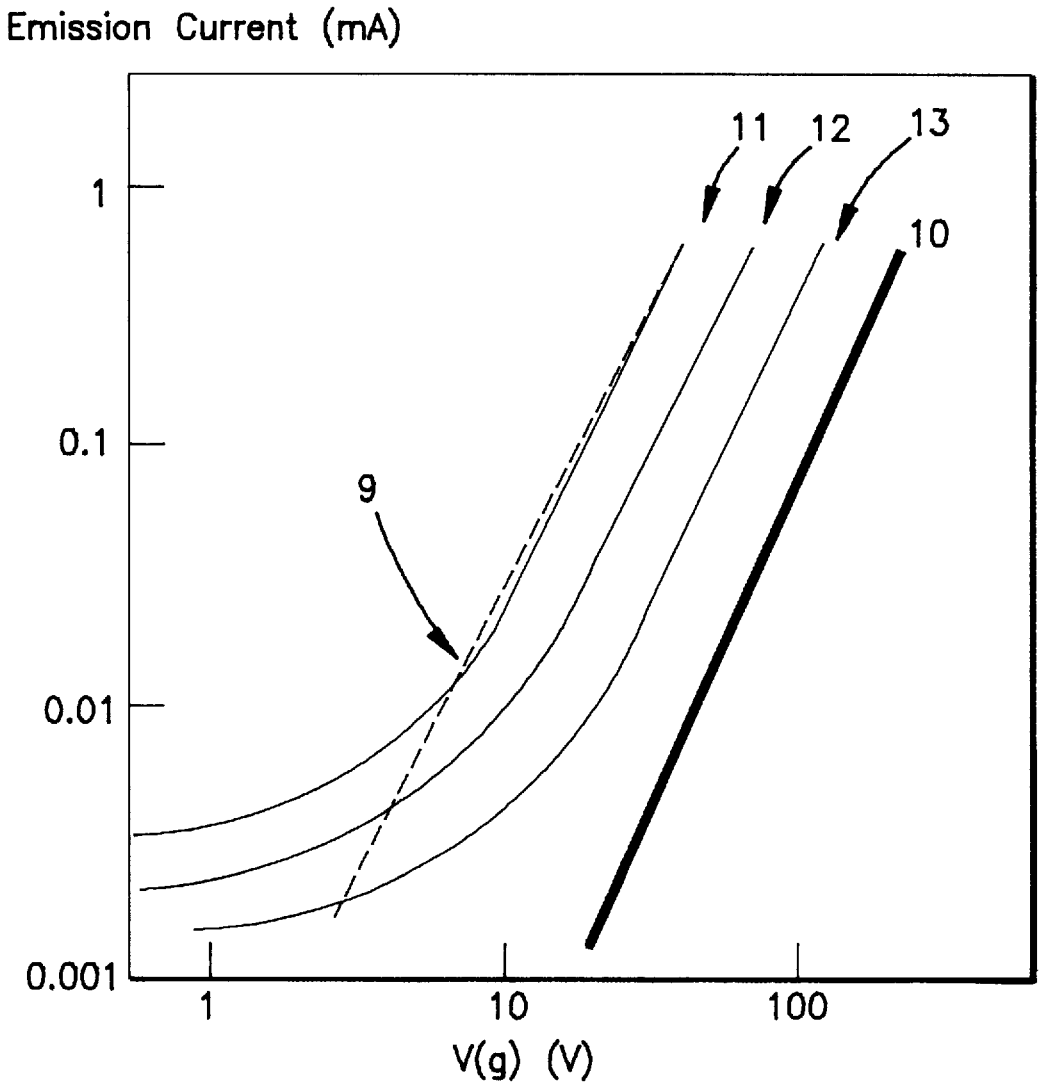
FIG. 2 is a diagram illustrative of a current-voltage characteristic for electron emission of a novel electron gun with a field emission cold cathode and an improved gate structure according to the present invention.

FIG. 2 illustrates the current-voltage characteristics of the above electron gun with the field emission cold cathode 1 and of another electron gun with a terminal cathode. The broken line 9 represents the current-voltage characteristic which is parallel to the broad real line 10 which represents the desirable gamma-property possessed by the thermal cathode electron gun. This means that the current-voltage characteristic represented by the broken line 9 has an apparent gamma-property. The real lines 11, 12 and 13 represent the current-voltage characteristics of the above electron gun with the field emission cold cathode 1 provided the voltage Vg2 applied to the secondary gate electrode 3 remain unchanged over various voltages Vg1 and fixed at predetermined voltage levels V11, V12 and V13 where V11>V12 >V13. If the voltage Vg2 is determined to comply with the following equation, then the desirable current-voltage characteristic being represented by the broken line 9 has the apparent gamma-property.

$$Vg2=\alpha(Vga-k) \text{ where } \alpha \text{ and k are constants.}$$

When the electron gun has the current-voltage characteristic represented by the broken line 9, the electron emission is suppressed in the low current region. By contrast, when the electron gun has the current-voltage characteristic represented by any of the real lines of 11, 12 and 13, the electron emission is not suppressed in the low current region. Namely, if the voltage Vg2 applied to the secondary gate electrode 3 complies with the above equation, then the electron gun has the current-voltage characteristic which has the apparent gamma-property.

As described above, the secondary gate electrode 3 has the electrical potential which is higher than the potential of the cathode 1 but lower than the potential of the primary gate electrode. This provides a current-voltage characteristic which suppresses the electron emission particularly in a low current region, and preferably provides an apparent gamma-property. The voltage between the cathode 1 and the secondary gate electrode 3 is preferably set to be proportional to the voltage between the cathode 1 and the primary gate electrode 2. This makes it possible to apply a video signal having the gamma-property directly onto the gate electrode or emitter without use of any other circuits or devices such as time division controller or property conversion circuits. This facilitates a simplification of the circuit configuration and structure of the electron gun as well as a driving of the electron gun under precise control.

Figure 3:
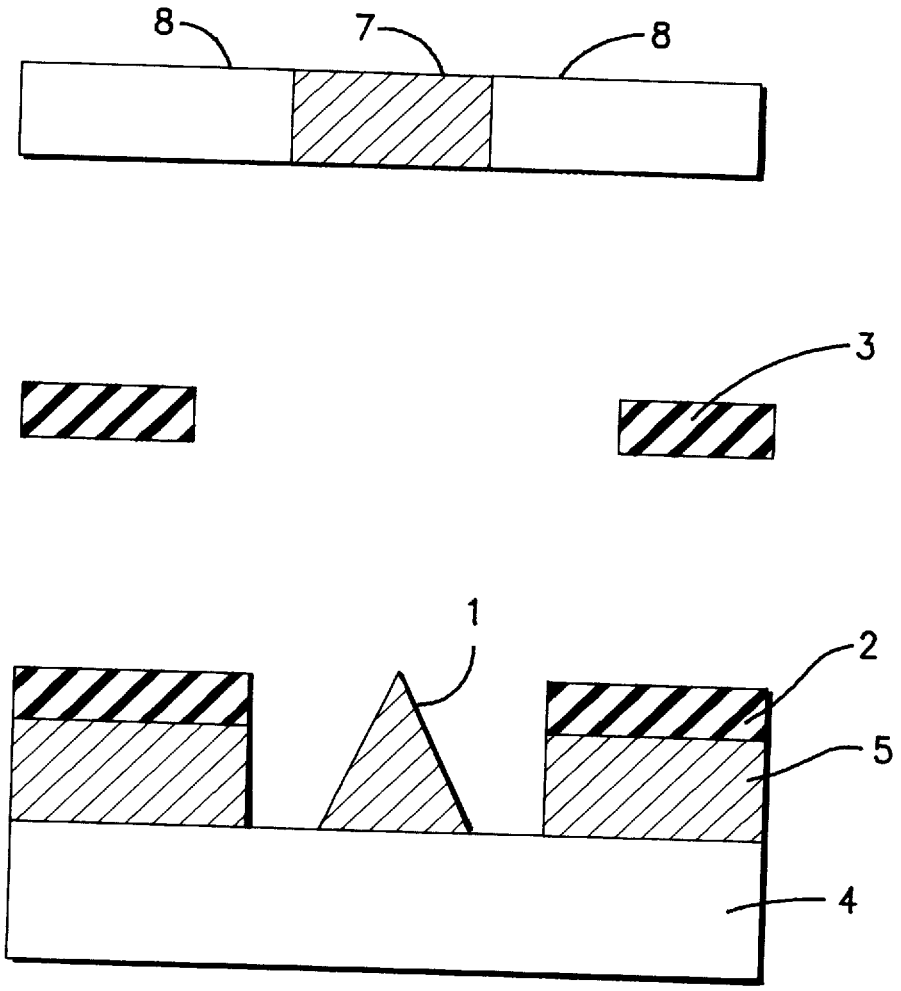
FIG. 3 is a cross sectional elevation view illustrative of a novel electron gun with a field emission cold cathode and an improved gate structure in a second embodiment according to the present invention.

A second embodiment according to the present invention will be described with reference to FIG. 3 in which the same reference numbers are used for the same or similar features.

Figure 4:
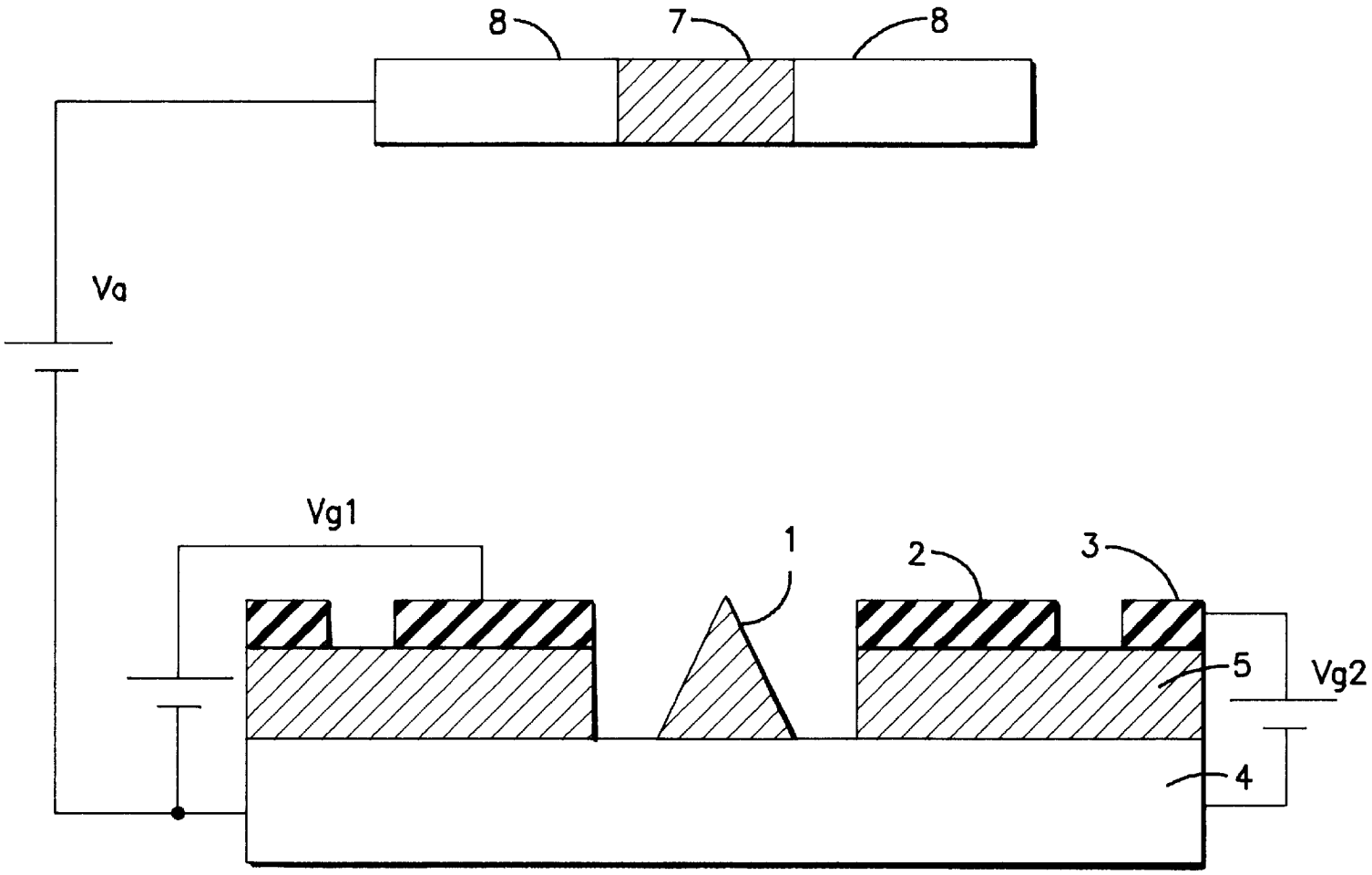
FIG. 4 is a cross sectional elevation view illustrative of a novel electron gun with a field emission cold cathode and an improved gate structure in a third embodiment according to the present invention.

A third embodiment according to the present invention will be described with reference to FIG. 4. In this embodiment voltage Vg2 applied to the secondary gate electrode 3 is set to cause electrons emitted from the cone-shaped cathode 1 to reduce the velocity at a position distanced not largely from the top of the cathode 1.

Figure 5:
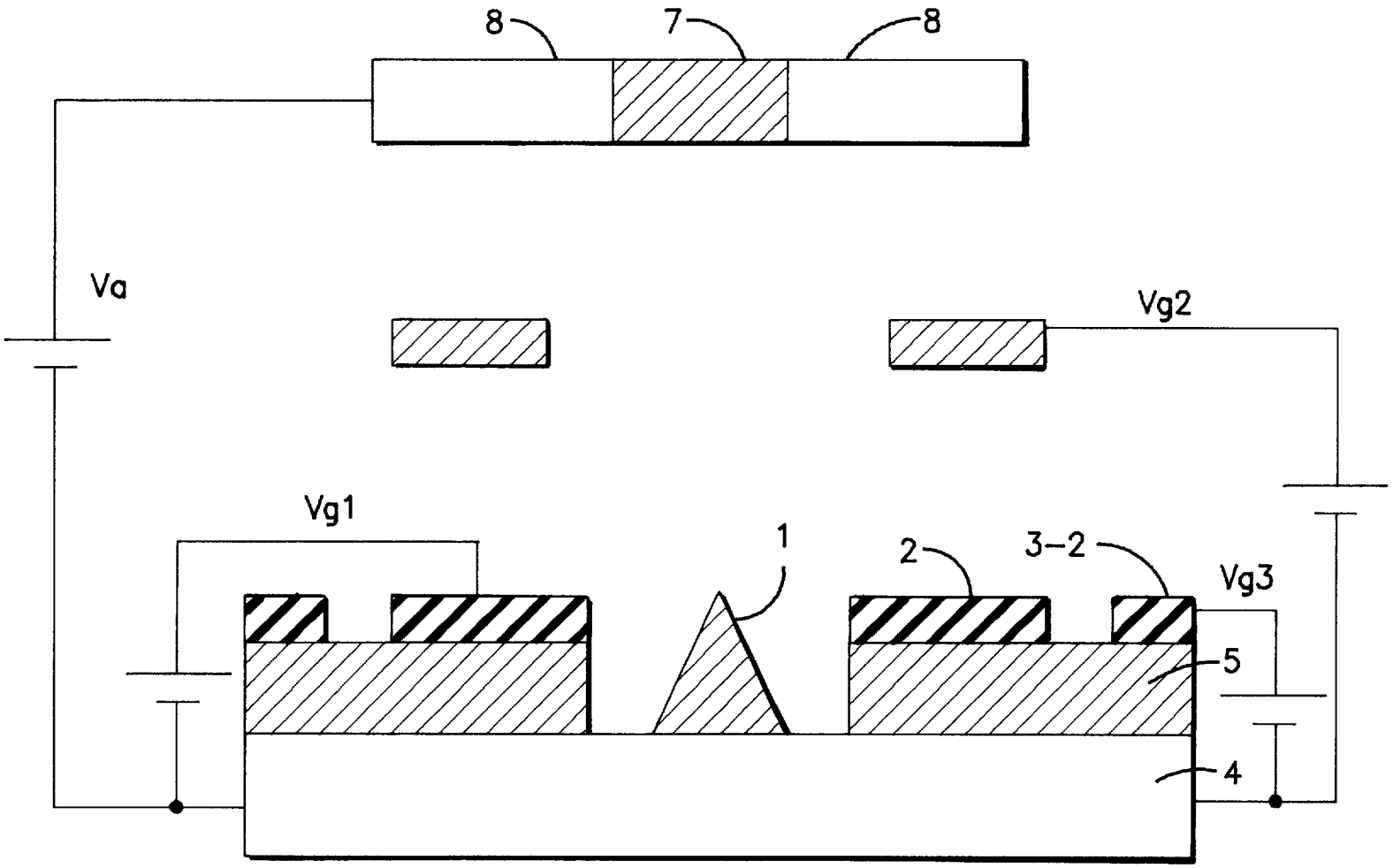
FIG. 5 is a cross sectional elevation view illustrative of a novel electron gun with a field emission cold cathode and an improved gate structure in a fourth embodiment according to the present invention.

A fourth embodiment according to the present invention will be described with reference to FIG. 5. In this embodiment secondary gate electrode 3-1 is provided so that the secondary gate electrode 3-1 is spaced apart and electrically separated from the primary gate electrode 2. A ternary gate electrode 3-2 having an opening portion is provided on a peripheral part of the first insulation film 5 so that the opening portion of the ternary gate electrode 3-2 surrounds the primary gate electrode 2 via space.

An anode electrode 8 in combination with a fluorescent substance 7 is provided over the secondary gate electrode 3-1 via a large distance therefrom.

A voltage Va is applied between the anode and the cathode 1. A voltage Vg1 is applied between the primary gate electrode 2 and the cathode 1. A voltage Vg2 is applied between the secondary gate electrode 3 and the cathode 1. The voltage Vg1 applied to the primary gate electrode 2 is set to cause an electron emission from the sharp-pointed top of the cone-shaped cathode 1. The voltage Vg2 applied to the secondary gate electrode 3-1 is lower than the voltage Vg1 applied to the primary gate electrode 2 and set to cause electrons emitted from the cone-shaped cathode 1 once to reduce the velocity in passing through the secondary gate electrode 3 and to suppress the electron emission when the amount of the electron emission is small. The voltage Vg3 applied to the ternary gate electrode 3-2 is lower than the voltage Vg1 applied to the primary gate electrode 2 and set to cause electrons emitted from the cone-shaped cathode 1 once to reduce the velocity in passing through the secondary gate electrode 3-1 and to suppress the electron emission when the amount of the electron emission is small. The voltage Va applied to the anode is larger than voltages Vg2 and Vg3 applied to the secondary and ternary gate electrodes 3-1 and 3-2 and set to cause that electrons having passed through the secondary gate electrode 3-1 accelerate the velocity toward the anode 8 so that accelerated electrons hit the fluorescent substance 7 whereby the fluorescent substance 7 generates fluorescence.

With reference back to FIG. 2, the broken line 9 represents the current-voltage characteristic which is parallel to the broad real line 10 which represents the desirable gamma-property possessed by the thermal cathode electron gun. This means that the current-voltage characteristic represented by the broken line 9 has the apparent gamma-property. The real lines 11, 12 and 13 represent the current-voltage characteristics of the above electron gun with the field emission cold cathode 1 provided the voltages Vg2 and Vg3 applied to the secondary and ternary gate electrodes 3-1 and 3-2 remain unchanged over various voltages Vg1 and fixed at predetermined voltage levels V11, V12 and V13 where V11>V12>V13. If the voltages Vg2 and Vg3 are determined to comply with the following equation, then the desirable current-voltage characteristic being represented by the broken line 9 and having the apparent gamma-property.

$Vg2=\beta\ (Vg1-k)$ and $Vg3=\beta\ (Vg1-k)$ where $\beta$ and k are constants.

When the electron gun has the current-voltage characteristic represented by the broken line 9, the electron emission is well suppressed in the low current region. By contrast, when the electron gun has the current-voltage characteristic represented by any of the real lines of 11, 12, and 13, the electron emission is not suppressed in the low current region. Namely, if the voltage Vg2 and Vg3 applied to the secondary and ternary gate electrodes 3-1 and 3-2 complies with the above equation, then the electron gun has the current-voltage characteristic which has apparent gamma-property.

As described above, the secondary and ternary gate electrodes 3-1 and 3-2 have the electrical potentials which are higher than the potential of the cathode 1 but lower than the potential of the primary gate electrode 2. This provides a current-voltage characteristic which suppresses the electron emission particularly in a low current region, and preferably provides an apparent gamma-property. The voltage between the cathode 1 and the secondary and ternary gate electrodes 3-1 and 3-2 are preferably set to be proportional to the voltage between the cathode 1 and the primary gate electrode 2. This makes it possible to apply a video signal having the gamma-property directly onto the gate electrode or emitter without use of any other circuits or devices such as time division controller or property conversion circuits. This facilitates a simplification of the circuit configuration and structure of the electron gun as well as a driving of the electron gun under precise control.

Figure 6:
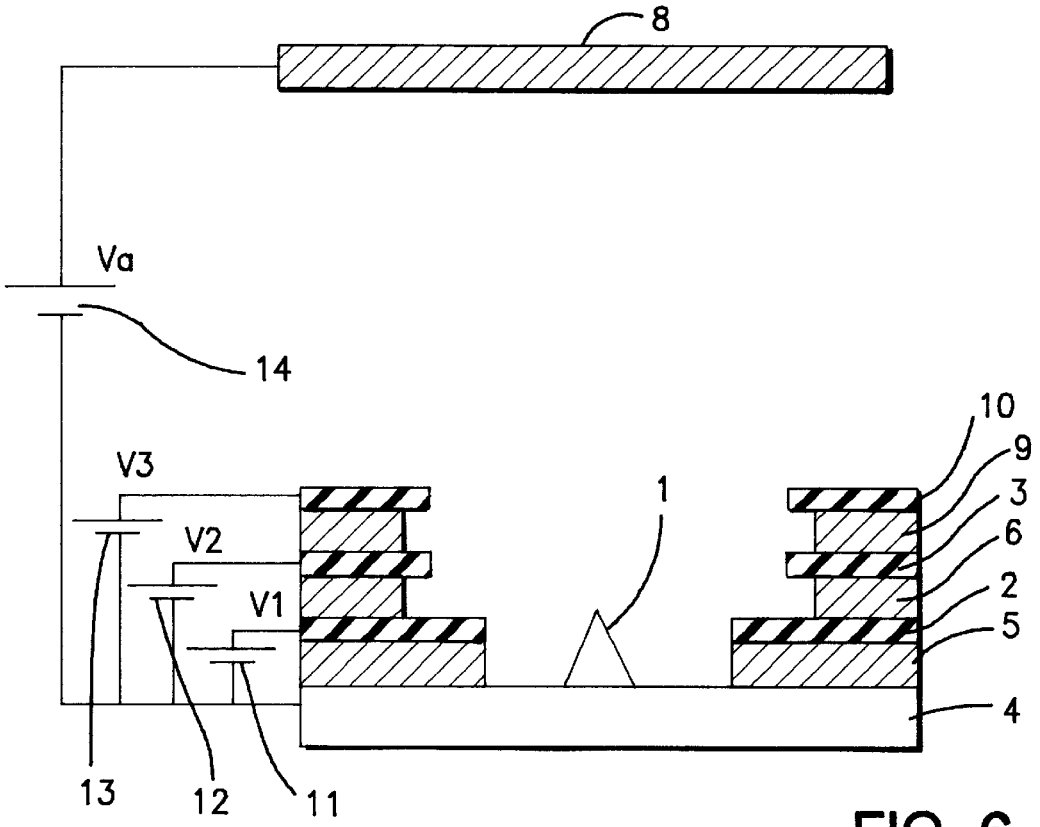
FIG. 6 is a cross sectional elevation view illustrative of a novel electron gun with a field emission cold cathode and an improved gate structure in a fifth embodiment according to the present invention.

A fifth embodiment according to the present invention will be described with reference to FIG. 6. A cathode 1 is provided on a substrate 4, which has a cone shape with a top sharp-pointed. A first insulation film 5 is provided on the substrate 4 and has an opening portion which surrounds the cathode 1. The first insulation film 5 has a circular-shaped opening portion which surrounds the cone-shaped cathode 1 via a gap. The thickness of the first insulation film 5 is smaller than a height of the cone-shaped cathode 1. A primary gate electrode 2 made of a metal is formed on the first insulation film 5. The primary gate electrode 2 has the opening portion which surrounds of the cone-shaped cathode 1. A second insulation film 6 is provided on the primary gate electrode 2. A secondary gate electrode 3 having an opening portion is provided on the second insulation film 6 so that the secondary gate electrode 3 is electrically separated from the primary gate electrode 2. A third insulation film 9 is provided on the secondary gate electrode 3. A ternary gate electrode 10 having an opening portion is provided on the third insulation film 9 so that the ternary gate electrode 10 is electrically separated from the secondary gate electrode 3.

An anode electrode 8 is provided over the ternary gate electrode 10 via a large distance therefrom.

A voltage Va is applied between the anode 8 and the cathode 1. A voltage V1 is applied between the primary gate electrode 2 and the cathode 1. A voltage Vg2 is applied between the secondary gate electrode 3 and the cathode 1 the voltage V1 applied to the primary gate electrode 2 is set to cause an electron emission from the sharp-pointed top of the cone-shaped cathode 1. The voltage V2 is applied to the secondary gate electrode 3 so that the potential of the secondary gate electrode 3 is lower than the potential of the cathode 1 and the absolute value of the voltage V2 is smaller than the absolute value of the voltage Vg1 applied to the primary gate electrode 2. The voltage V2 is set to cause electrons emitted from the cone-shaped cathode 1 once to reduce the velocity in passing through the secondary gate electrode 3. Since the potential of the secondary gate electrode 3 is lower than the potential of the cathode 1, electrons do not reach the secondary gate electrode 3. The voltage V3 is applied to the ternary gate electrode 10 so that the potential of the ternary gate electrode 10 is much higher than the potential of the cathode 1 to cause electrons having passed through the secondary gate electrode 3 to accelerate the velocity toward the anode 8. The voltage Va applied to the anode 8 is set to cause electrons having passed through the secondary gate electrode 3 further to accelerate the velocity toward the anode 8 so that accelerated electrons hit the anode 8. The potential of the cathode 1 is 0V. The potential of the primary gate electrode 2 is 70V. The potential of the secondary gate electrode 3 is −10V. The potential of the ternary gate electrode 10 is 150V. The diameter of the opening of the primary gate electrode 2 is 0.8 micrometers. The diameter of the opening of the secondary gate electrode 3 is 1.2 micrometers. The diameter of the opening of the ternary gate electrode 10 is 1.4 micrometers. The thickness of the first insulation film 5 is 0.5 micrometers. The thickness of the second insulation film 6 is 0.5 micrometers. The third of the first insulation film 9 is 0.5 micrometers.

Figure 7:
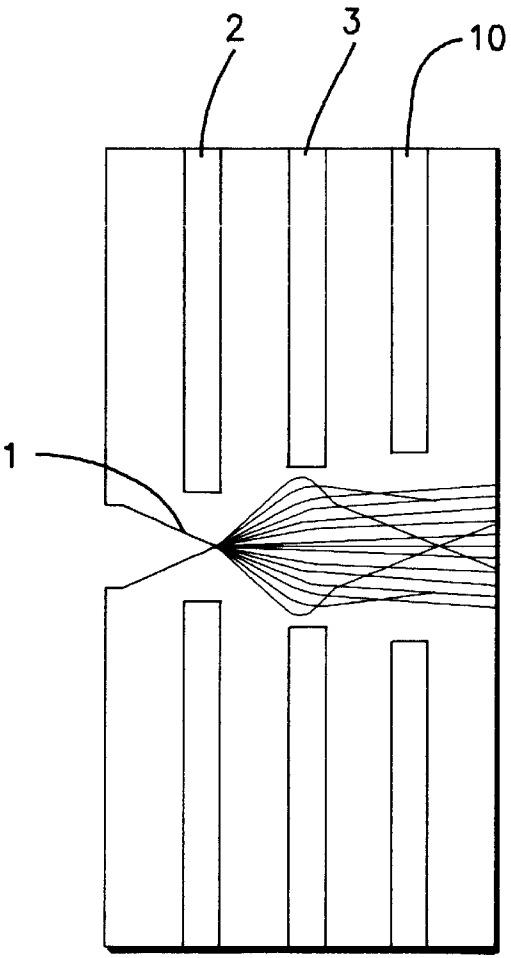
FIG. 7 is a view illustrative of orbits of electrons having emitted from a cathode and being on travel in another novel electron gun with a field emission cold cathode and another improved gate structure in a fifth embodiment according to the present invention.

FIG. 7 is illustrative of orbits of electrons emitted from a cathode and travelling in another novel electron gun with a field emission cold cathode and another improved gate structure in the fifth embodiment according to the present invention.

As illustrated in FIG. 7, the secondary gate electrode 3 has the electrical potential which is lower than the first electrical potential of the cathode 1 for reduction in the vertical velocity component of electrons emitted from the cathode 1 in a direction vertical to the traveling direction along which the electrons travel toward the anode 8 and prevents the electrons from reaching the secondary gate electrode 3. By contrast, the ternary gate electrode 10 has the electrical potential which is higher than the electrical potential of the primary gate electrode 2 for acceleration in the parallel velocity component of the electrons emitted from the cathode in a direction parallel to the traveling direction along which the electrons travel toward the anode 8. In cooperation with the secondary gate electrode 3, the ternary gate electrode 10 provides an electrical field which causes the electrons emitted from the cathode to have a minimum ratio of the average of the vertical velocity component to the parallel velocity component. This suppresses the spread of the electron beam emitted from the cathode, resulting in a convergence of the electron beam. As a result, there is no possibility that electrons emitted from the cathode turn toward and reach the secondary gate electrode 3 and ternary gate electrode 10. This prevents any of the undesirable gate current.

If the ternary gate electrode 10 did not have a high potential contrary to this embodiment whilst the secondary gate electrode 3 has a potential lower than the potential of the cathode in accordance with this embodiment, then an equipotential surface of a lower potential than the necessary potential for causing the electron emission is formed over the cathode. As a result, no electron emission is caused.

Figure 8:
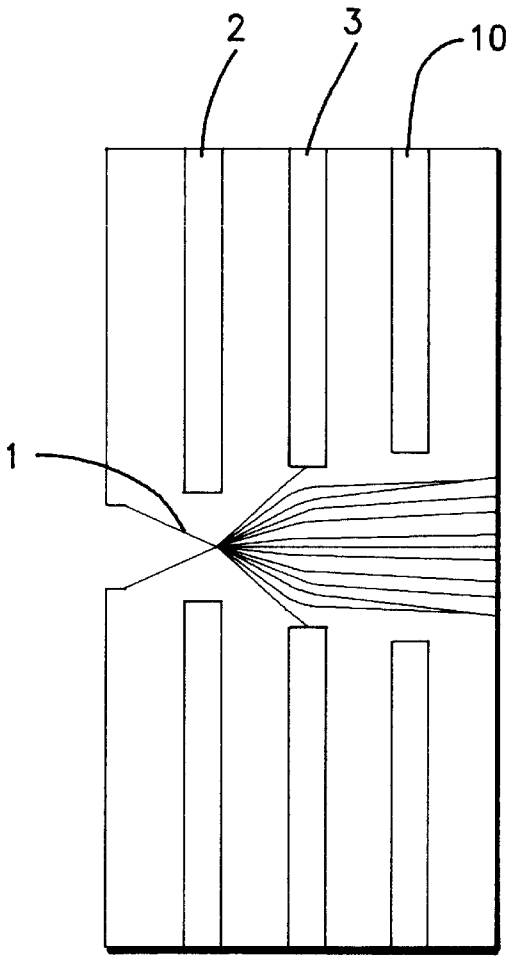
FIG. 8 is a view illustrative of orbits of electrons having emitted from a cathode and being on travel in the conventional electron gun with a field emission cold cathode and the well known gate structure in prior art.

If, however, the ternary gate electrode 10 has the high potential in accordance with this embodiment whilst the secondary gate electrode 3 has a potential higher than the potential of the cathode contrary to his embodiment, then electrons having emitted from the cathode may turn toward and may reach the secondary gate electrode 3, resulting in an undesirable gate current as illustrated in FIG. 8, where the voltage applied to the primary gate electrode 2 is 70V whilst the voltage applied to the secondary gate electrode 3 is 5V in addition the voltage applied to the ternary gate electrode 10 is 70V.

For the above reasons, it is very important for this embodiment that the secondary gate electrode 3 has an electrical potential which is lower than the electrical potential of the cathode 1 for reduction in the vertical velocity component of electrons having emitted from the cathode in a direction vertical to the traveling direction, whilst the ternary gate electrode 10 has the electrical potential which is higher than the electrical potential of the cathode 1 for acceleration in the parallel velocity component of the electrons emitted from the cathode in a direction parallel to the traveling direction so that, in cooperation with the secondary gate electrode 3, the ternary gate electrode 10 provides an electric field which causes that the electrons emitted from the cathode to have an approximately minimum ratio in average of the vertical velocity component to the parallel velocity component.

Figure 9:
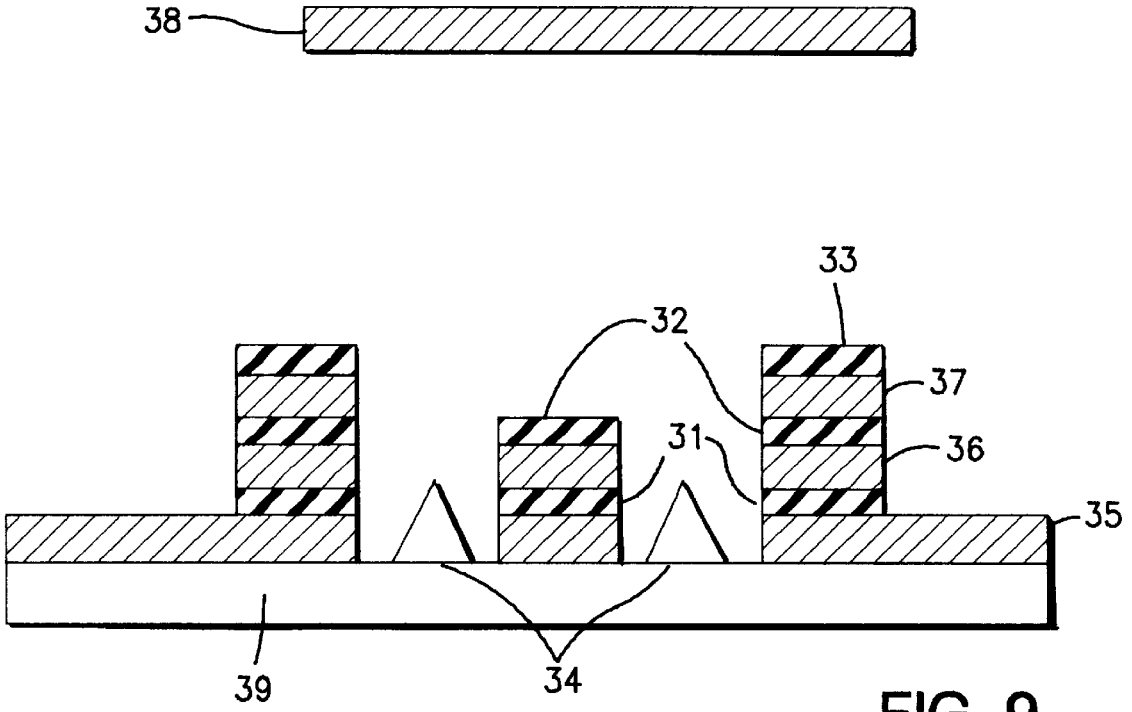
FIG. 9 is a cross sectional elevation view illustrative of another novel electron gun with a field emission cold cathode and another improved gate structure in a sixth embodiment according to the present invention.

A sixth embodiment according to the present invention will be described with reference to FIG. 9. Arrays of cathodes 34 are provided on a substrate 39, each of which has a cone shape with a top sharp-pointed. A first insulation film 35 is provided on the substrate 39 and has arrays of opening portions, each of which surrounds each the cathode 34. The thickness of the first insulation 35 is smaller than a height of the cone-shaped cathodes 34. A primary gate electrode 31 made of a metal is formed on the first insulation film 35. The primary gate electrode 31 has arrays of opening portions, each of which surrounds each of the cone-shaped cathodes 34. A second insulation film 36 is provided on the primary gate electrode 31. A secondary gate electrode 32 is provided on the second insulation film 36 so that the secondary gate electrode 32 is electrically separated from the primary gate electrode 31. The secondary gate electrode 32 has arrays of opening portions, each of which surrounds each of the cathodes 34. A third insulation film 37 is provided on the secondary gate electrode 32. The third insulation film 37 has a large opening portion which surrounds the arrays of the cathodes 34. A ternary gate electrode 33 is provided on the third insulation film 37 so that the ternary gate electrode 33 is electrically separated from the secondary gate electrode 32. The ternary gate electrode 33 has a single large opening portion with the same diameter as that of the third insulation film 37.

An anode electrode 38 is provided over the ternary gate electrode 33 via a large distance therefrom.

A voltage Va is applied between the anode 38 and the cathode 34. A voltage V1 is applied between the primary gate electrode 31 and the cathode 34. A voltage V2 is applied between the secondary gate electrode 32 and the cathode 34. The voltage V1 applied to the primary gate electrode 32 is set to cause an electron emission from the sharp-pointed top of the cone-shaped cathode 34. The voltage V2 is applied to the secondary gate electrode 32 so that the potential of the secondary gate electrode 32 is lower than the potential of the cathode 34 and the absolute value of the voltage V2 is smaller than the absolute value of the voltage V1 applied to the primary gate electrode 31. The voltage V2 is set to cause electrons emitted from the cone-shaped cathode 34 once to reduce the velocity in passing through the secondary gate electrode 32. Since the potential of the secondary gate electrode 32 is lower than the potential of the cathode 34, it is surely prevented that electrons reach the secondary gate electrode 32. The voltage V3 is applied to the ternary gate electrode 33 so that the potential of the ternary gate electrode 33 is much higher than the potential of the cathode 34 to cause electrons having passed through the secondary gate electrode 32 to accelerate toward the anode 38. The voltage Va applied to the anode 38 is set to cause electrons having passed through the secondary gate electrode 32 further to accelerate toward the anode 38 so that accelerated electrons hit the anode 38. The potential of the cathode 34 is 0V. The potential of the primary gate electrode 31 is 70V. The potential of the secondary gate electrode 32 is −10V. The potential of the ternary gate electrode 33 is 150V.

The secondary gate electrode 32 has the electrical potential which is lower than the first electrical potential of the cathode 34 for reduction in the vertical velocity component of electrons emitted from the cathode 34 in a direction vertical to the traveling direction along which the electrons travel toward the anode 38 and prevents the electrons from reaching the secondary gate electrode 32. By contrast, the ternary gate electrode 33 has the electrical potential which is higher than the electrical potential of the primary gate electrode 31 for acceleration in the parallel velocity component of the electrons having emitted from the cathode in a direction parallel to the traveling direction along which the electrons travel toward the anode 38. In cooperation with the secondary gate electrode 32, the ternary gate electrode 33 provides an electric field which causes the electrons emitted from the cathode have a minimum ratio of the average of the vertical velocity component to the parallel velocity component. This suppresses spread of the electron beam emitted from the cathode, resulting in a well convergence of the electron beam. As a result, there is no possibility that electrons having emitted from the cathode turn toward and reach the secondary gate electrode 32 and ternary gate electrode 33. This surely prevents any of the undesirable gate current.

For the above reasons, it is very important for this embodiment that the secondary gate electrode 32 has an electrical potential which is lower than the electrical potential of the cathode 34 for reduction in the vertical velocity component of electrons emitted from the cathode in a direction vertical to the traveling direction, whilst the ternary gate electrode 33 has the electrical potential which is higher than the electrical potential of the cathode 34 for acceleration in the parallel velocity component of the electrons emitted from the cathode in a direction parallel to the traveling direction so that, in cooperation with the secondary gate electrode 32, the ternary gate electrode 33 provides an electric field which causes that the electrons having emitted from the cathode have an approximately minimum ratio of the average of the vertical component to the parallel velocity component.

Figure 10:
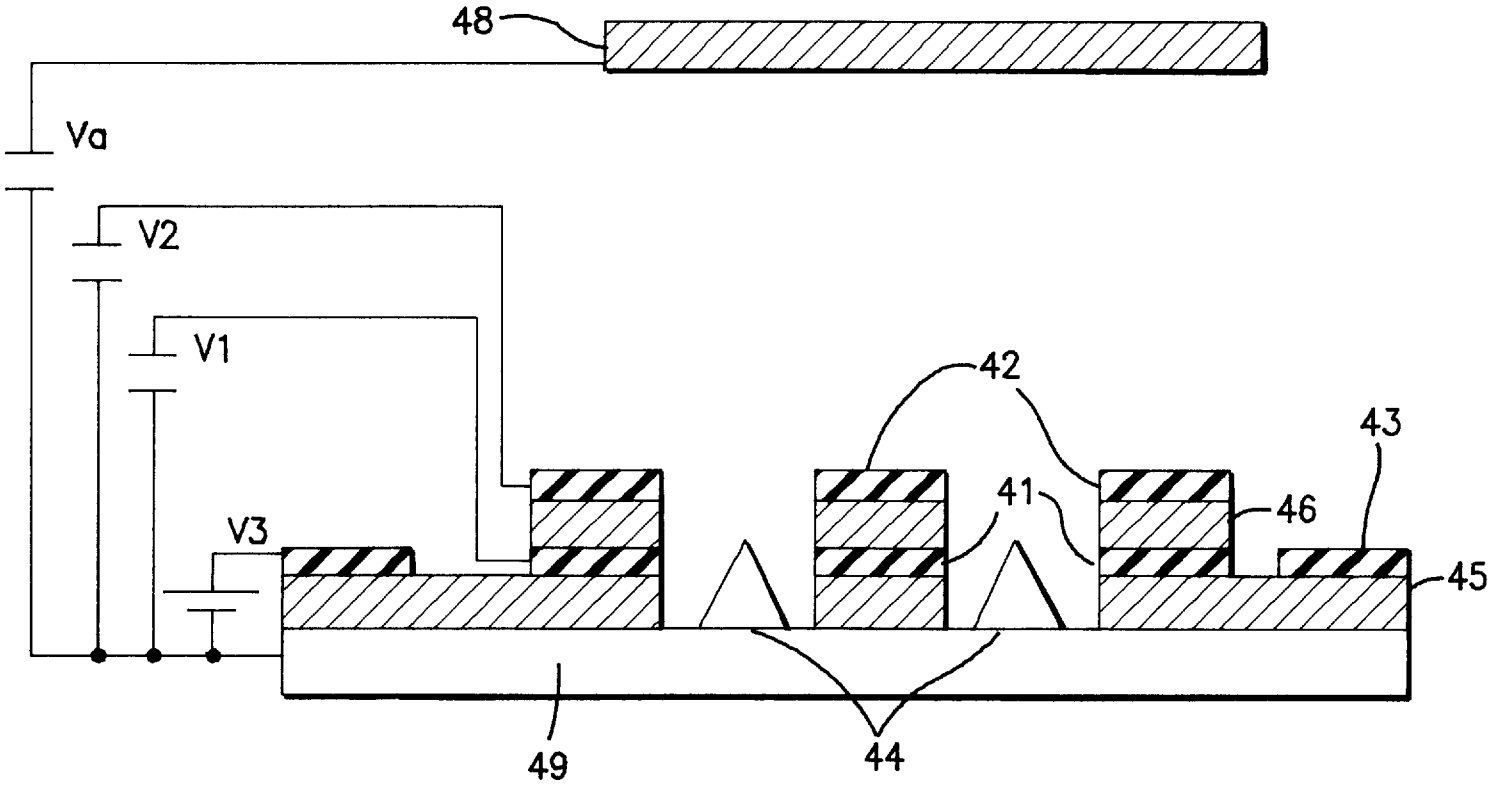
FIG. 10 is a cross sectional elevation view illustrative of another novel electron gun with a field emission cold cathode and another improved gate structure in a seventh embodiment according to the present invention.

A seventh embodiment according to the present invention will be described with reference to FIG. 10. Arrays of cathodes 44 are provided on a substrate 49, each of which has a cone shape with a top sharp-pointed. A first insulation film 45 is provided on apart of the substrate 49 and has arrays of opening portions, each of which surrounds a cathode 44. The thickness of the first insulation film 45 is smaller than a height of the cone-shaped cathodes 44. A primary gate electrode 41 made of a metal is formed on the first insulation film 45. The primary gate electrode 41 has arrays of opening portions, each of which surrounds of each the cone-shaped cathode 44. A second insulation film 46 is provided on the primary gate electrode 41. A secondary gate electrode 42 is provided on the second insulation film 46 so that the secondary gate electrode 42 is electrically separated from the primary gate electrode 41. The secondary gate electrode 42 has arrays of opening portions, each of which surrounds one of the cathodes 44. A ternary gate electrode 43 is provided on the peripheral part of the third insulation film 47 so that the ternary gate electrode 43 is spaced apart from the primary gate electrode 41. The ternary gate electrode 43 has a single large opening portion surrounds the primary gate electrode 41 via spaces.

An anode electrode 48 is provided over the ternary gate electrode 43 via a large distance therefrom.

A voltage Va is applied between the anode 48 and the cathode 44. A voltage V1 is applied between the primary gate electrode 41 and the cathode 44. A voltage V2 is applied between the secondary gate electrode 42 and the cathode 44. The voltage V1 applied to the primary gate electrode 41 is set to cause an electron emission from the sharp-pointed top of the cone-shaped cathode 44. The voltage V2 is applied to the secondary gate electrode 42 so that the potential of the secondary gate electrode 41 is lower than the potential of the cathode 44 and the absolute value of the voltage V2 is smaller than the absolute value of the voltage V1 applied to the primary gate electrode 41. The voltage V2 is set to cause that electrons emitted from the cone-shaped cathode 44 once to reduce the velocity in passing through the secondary gate electrode 42. Since the potential of the secondary gate electrode 42 is lower than the potential of the cathode 44, it is surely prevented that electrons reach the secondary gate electrode 42. The voltage V3 is applied to the ternary gate electrode 43 so that the potential of the ternary gate electrode 43 is much higher than the potential of the cathode 44 to cause that electrons having passed through the secondary gate electrode 42 accelerate the velocity toward the anode 48. The voltage Va applied to the anode 48 is set to cause electrons having passed through the secondary gate electrode 42 further to accelerate the velocity toward the anode 48 so that accelerated electrons hit the anode 48. The potential of the cathode 44 is 0V. The potential of the primary gate electrode 41 is 70V. The potential of the secondary gate electrode 42 is −10V. The potential of the ternary gate electrode 42 is 150V.

The secondary gate electrode 42 has the electrical potential which is lower than the first electrical potential of the cathode 44 for reduction in the vertical velocity component of electrons emitted from the cathode 44 in a direction vertical to the traveling direction along which the electrons travel toward the anode 48 and prevents the electrons from reaching the secondary gate electrode 42. By contrast, the ternary gate electrode 43 has the electrical potential which is higher than the electrical potential of the primary gate electrode 41 for acceleration in the parallel velocity component of the electrons emitted from the cathode in a direction parallel to the traveling direction along which the electrons travel toward the anode 48. In cooperation with the secondary gate electrode 42, the ternary gate electrode 43 provides an electric field which causes that the electrons emitted from the cathode have a minimum ratio in average of the vertical velocity component to the parallel velocity component. This suppresses spread of the electron beam having emitted from the cathode, resulting in a convergence of the electron beam. As a result, there is no possibility that electrons emitted from the cathode turn toward and reach the secondary gate electrode 42 and ternary gate electrode 43. This prevents any of the undesirable gate current.

For the above reasons, it is very important for this embodiment that the secondary gate electrode 42 has an electrical potential which is lower than the electrical potential of the cathode 44 for reduction in the vertical velocity component of electrons emitted from the cathode in a direction vertical to the traveling direction, whilst the ternary gate electrode 43 has the electrical potential which is higher than the electrical potential of the cathode 44 for acceleration in the parallel velocity component of the electrons emitted from the cathode in a direction parallel to the traveling direction so that, in cooperation with the secondary gate electrode 42, the ternary gate electrode 43 provides an electric field which causes the electrons emitted from the cathode to have an approximately minimum ration of the average of the vertical velocity component to the parallel velocity component.

Figure 11:
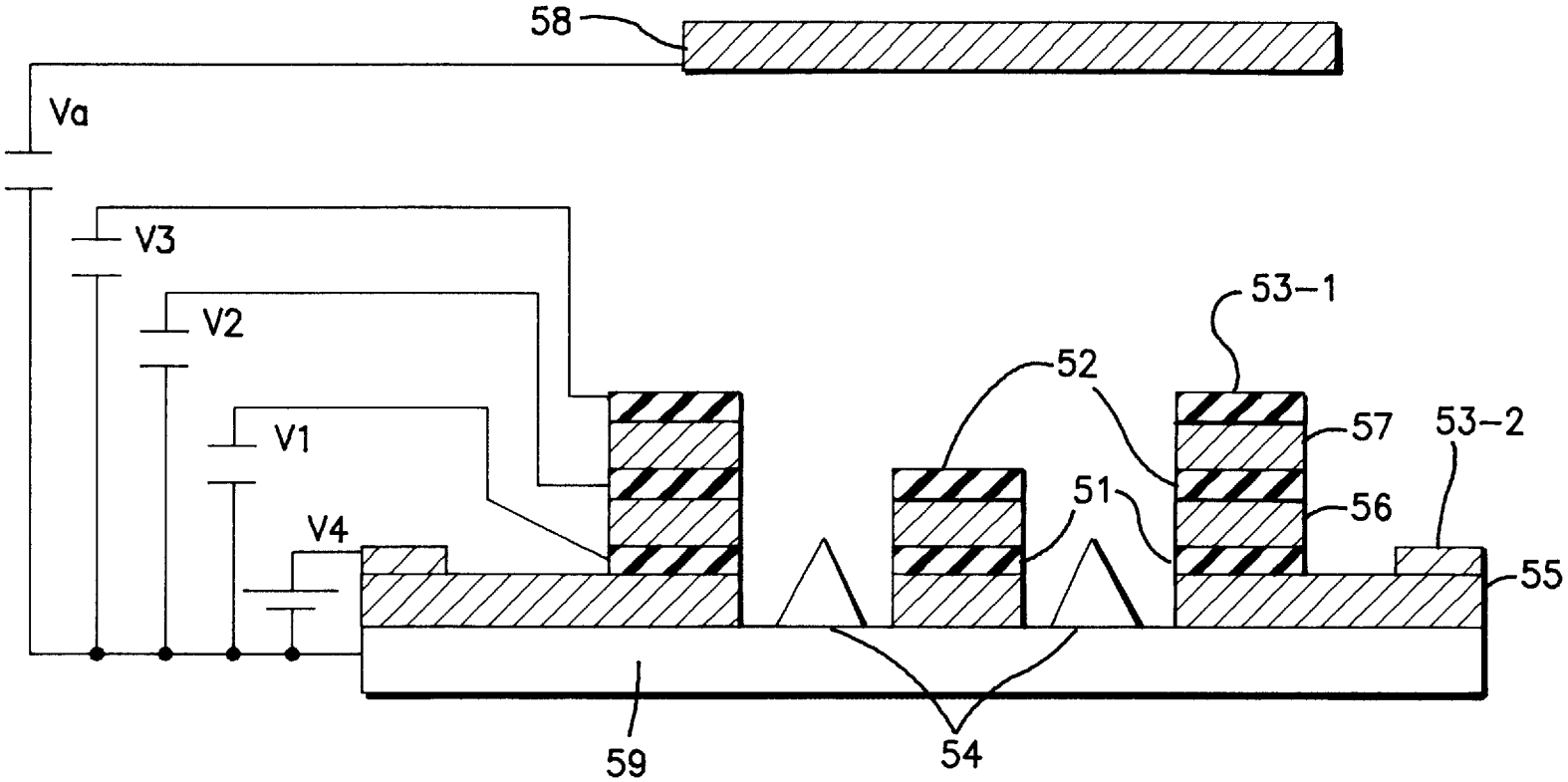
FIG. 11 is a cross sectional elevation view illustrative of another novel electron gun with a field emission cold cathode and another improved gate structure in an eighth embodiment according to the present invention.

An eighth embodiment according to the present invention will be described with reference to FIG. 11. Arrays of cathode 54 are provide on a substrate 59, each of which has cone shape with a top sharp-pointed. A first insulation film 55 is provided on a part of the substrate 59 and has arrays of opening portions, each of which surrounds each the cathode 54. The thickness of the first insulation film 55 is smaller than a height of the cone-shaped cathodes 54. A primary gate electrode 51 made of a metal is formed on the first insulation film 55. The primary gate electrode 51 has arrays of opening portions, each of which surrounds one of the cone-shaped cathode 54. A second insulation film 56 is provided on the primary gate electrode 51. A secondary gate electrode 52 is provided on the second insulation film 56 so that the secondary gate electrode 52 is electrically separated from the primary gate electrode 51. The secondary gate electrode 52 has arrays of opening portions, each of which surrounds one of the cathodes 54. A third insulation film 57 is provided on the secondary gate electrode 52. The third insulation film 57 has a single large opening portion which surrounds the arrays of the cathode 54. A ternary gate electrode 53-1 is provided on the third insulation film 57 so that the ternary gate electrode 53-1 is electrically separated from the secondary gate electrode 52. The ternary gate electrode 53-1 has a single large opening portion with the same diameter as that of the third insulation film 57. A quaternary gate electrode 53-2 is further provided on a peripheral part of the third insulation film 57 so that the quaternary gate electrode 53-2 is spaced apart from the primary gate electrode 51. The quaternary gate electrode 53-2 has a single large opening portion surrounding the primary gate electrode 51.

An anode electrode 58 is provided over the ternary gate electrode 52-1 via a large distance therefrom.

A voltage Va is applied between the anode 58 and the cathode 54. A voltage V1 is applied between the primary gate electrode 51 and the cathode 54. A voltage V2 is applied between the secondary gate electrode 52 and the cathode 44. The voltage V1 applied to the primary gate electrode 41 is set to cause an electron emission from the sharp-pointed top of the cone-shaped cathode 54. The voltage V2 is applied to the secondary gate electrode 52 so that the potential of the secondary gate electrode 52 is lower than the potential of the cathode 54 and the absolute value of the voltage V2 is smaller than the absolute value of the voltage V1 applied to the primary gate electrode 51. The voltage V2 is set to cause that electrons emitted from the cone-shaped cathode 54 once to reduce the velocity in passing through the secondary gate electrode 52. Since the potential of the secondary gate electrode 52 is lower than the potential of the cathode 54, it is surely prevented that electrons reach the secondary gate electrode 52. The voltage V3 is applied to the ternary gate electrode 53-1 so that the potential of the ternary gate electrode 53-1 is much higher than the potential of the cathode 54 to cause that electrons having passed through the secondary gate electrode 52 to accelerate toward the anode 58. The voltage V4 is applied to the quaternary gate electrode 53-2 so that the potential of the quaternary gate electrode 53-2 is much higher than the potential of the cathode 54 to cause that electrons having passed through the secondary gate electrode 52 further accelerate the velocity toward the anode 58. The voltage Va applied to the anode 48 is set to cause that electrons having passed through the secondary gate electrode 42 further accelerate the velocity toward the anode 58 so that accelerated electrons hit the anode 58.

The secondary gate electrode 52 has the electrical potential which is lower than the electrical potential of the cathode 54 for reduction in the vertical velocity component of electrons having emitted from the cathode 54 in a direction vertical to the traveling direction along which the electrons travel toward the anode 58 and prevents the electrons from reaching the secondary gate electrode 52. By contrast, the ternary and quaternary gate electrodes 53-1 and 53-2 have the electrical potentials which are higher than the electrical potential of the primary gate electrode 51 for acceleration in the parallel velocity component of the electrons having emitted from the cathode in a direction parallel to the traveling direction along which the electrons travel toward the anode 58. In cooperation with the secondary gate electrode 52, the ternary and quaternary gate electrodes 53-1 and 53-2 provide an electric field which causes the electrons emitted from the cathode to have a minimum ratio of the average of the vertical velocity component to the parallel velocity component. This suppresses spread of the electron beam emitted from the cathode, resulting in a convergence of the electron beam. As a result, there is no possibility that electrons having emitted from the cathode turn toward and reach the secondary gate electrode 52 and ternary gate electrode 53. This prevents any of the undesirable gate current.

For the above reasons, it is very important for this embodiment that the secondary gate electrode 52 has an electrical potential which is lower than the electrical potential of the cathode 54 for reduction in the vertical velocity component of electrons having emitted from the cathode in a direction vertical to the traveling direction, whilst the ternary and quaternary gate electrodes 53-1 and 53-2 have the electrical potentials which are higher than the electrical potential of the cathode 54 for acceleration in the parallel velocity component of the electrons having emitted from the cathode in a direction parallel to the traveling direction so that, in cooperation with the secondary gate electrode 52, the ternary and quaternary gate electrodes 53-1 and 53-2 provide an electric field which causes that the electrons having emitted from the cathode have the minimum ratio in average of the vertical velocity component to the parallel velocity component.

Figure 12:
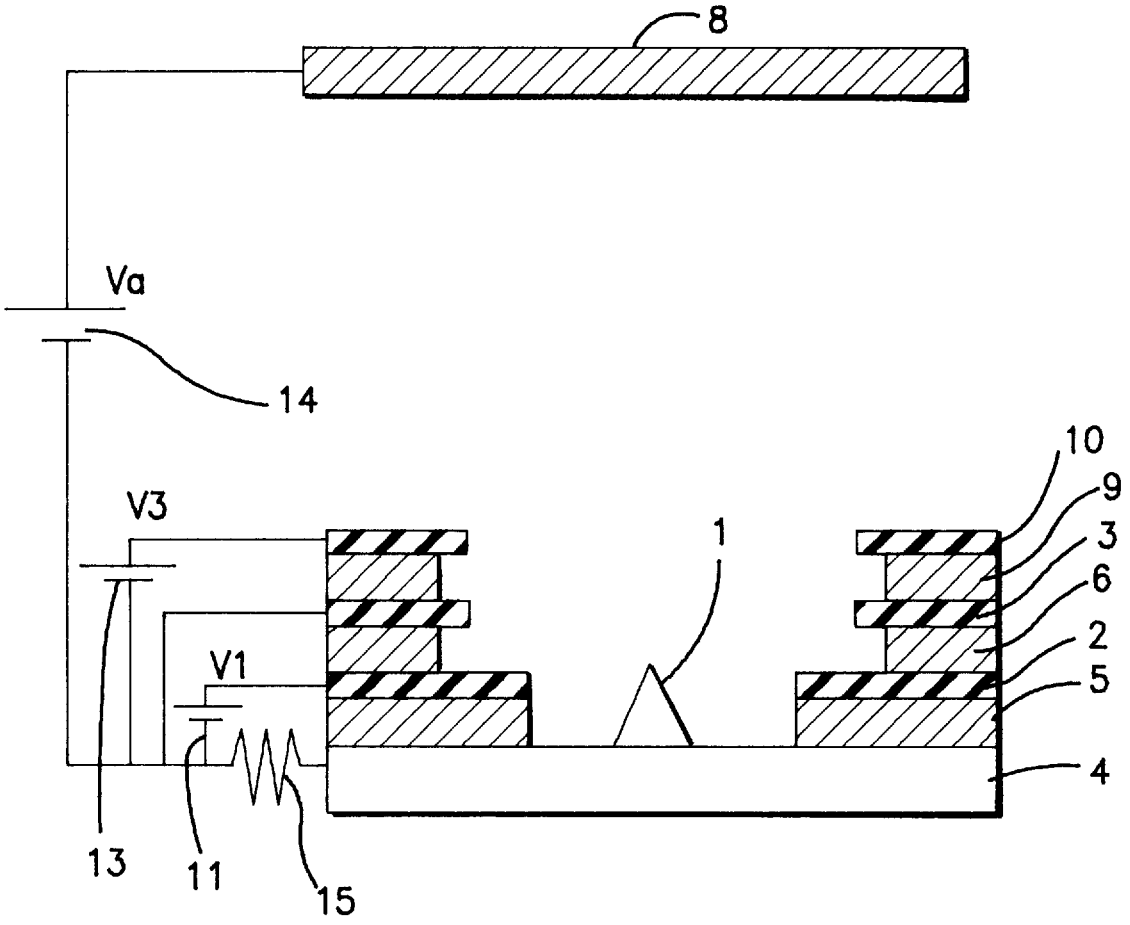
FIG. 12 is a cross sectional elevation view illustrative of another novel electron gun with a field emission cold cathode and another improved gate structure in a ninth embodiment according to the present invention.

A ninth embodiment according to the present invention will be described with reference to FIG. 12. In this embodiment a resistor 15 is connected to the substrate 4 which is conductive to the cathode 1, wherein the substrate 4 and the cathode 1 have substantially the same potential. A first dc power supply 11 generating the voltage V1 is provided between the primary gate electrode 2 and the resistor 15. The secondary gate electrode 3 is electrically connected through the resistor 15 to the substrate 4. A second dc power supply 13 generating the voltage V3 is provided between the ternary gate electrode 10 and the resistor 15. A third dc power supply 14 generating the voltage Va is electrically connected between the resistor 15 and the anode 8. The voltage V1 applied to the primary gate electrode 2 and the resistor 15 are selected to cause an electron emission from the sharp-pointed top of the cone-shaped cathode 1. The resistance of resistor 15 drops the potential of the secondary gate electrode 3 so that the potential of the secondary gate electrode 3 is lower than the potential of the cathode 1 but the absolute value of the voltage V2 is smaller than the absolute value of the voltage V1 applied to the primary gate electrode 2. The resistance of resistor 15 is selected to cause electrons emitted from the cone-shaped cathode 1 once to reduce the velocity in passing through the secondary gate electrode 3. Since the potential of the secondary gate electrode 3 is lower than the potential of the cathode 1, the electrons do not reach the secondary gate electrode 3. The voltage V3 is applied to the ternary gate electrode 10 so that the potential of the ternary gate electrode 10 is much higher than the potential of the cathode 1 to cause electrons having passed through the secondary gate electrode 3 to accelerate toward the anode 8. The voltage Va applied to the anode 8 is set to cause electrons having passed through the secondary gate electrode 3 further to accelerate toward the anode 8 so that accelerated electrons hit the anode 8. The potential of the cathode 1 is 0V. The potential of the primary gate electrode 2 is 70V. The potential of the secondary gate electrode 3 is −10V. The potential of the ternary gate electrode 10 is 150V. The diameter of the opening of the primary gate electrode 2 is 0.8 micrometers. The diameter of the opening of the secondary gate electrode 3 is 1.2 micrometers. The diameter of the opening of the ternary gate electrode 10 is 1.4 micrometers. The thickness of the first insulation film 5 is 0.5 micrometers. The thickness of the second insulation film 6 is 0.5 micrometers. The third of the first insulation film 9 is 0.5 micrometers.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims any modifications which fall within the spirit and scope of the present invention.

What is claimed is:

1. A gate structure of an electron gun having a field emission cold cathode having a first electrical potential, said gate structure comprising:

a primary gate electrode having a first opening portion surrounding said top of said cathode, said primary gate electrode having a second electrical potential which is higher than said first electrical potential for causing an electron emission from said top of said cathode; and at least a secondary gate electrode having a second opening portion and being spaced apart from said primary gate electrode in a direction parallel to a traveling direction along which electrons emitted from said top of said cathode travel, said secondary gate electrode having a third electrical potential which is higher than said first electrical potential and lower than said second electrical potential so as to provide a current-voltage characteristic which suppresses said electron emission in a low current region, wherein a second voltage defined as a difference between said first and third electrical potentials varies in proportion to a first voltage defined as a difference between said first and second electrical potentials so that said current-voltage characteristic has an apparent gamma-property.

2. The gate structure as claimed in claim 1, wherein said first opening portion of said primary gate electrode is smaller than said second opening portion of said secondary gate electrode.

3. The gate structure as claimed in claim 1, wherein said primary and secondary gate electrodes are separated by an insulation film.

4. The gate structure as claimed in claim 1, wherein said primary and secondary gate electrodes are separated by space.

5. The gate structure as claimed in claim 1, wherein said cathode has a cone shape with a top pointed.

6. The gate structure as claimed in claim 1, further comprising:

a ternary gate electrode having a third opening portion surrounding said primary gate electrode, said ternary gate electrode being spaced apart from said primary gate electrode in a direction perpendicular to said traveling direction, said ternary gate electrode having a fourth electrical potential which is higher than said first electrical potential and lower than said second electrical potential so as to provide, in cooperation with said secondary gate electrode, said current-voltage characteristic which suppresses said electron emission in a low current region.

7. A gate structure of an electron gun having a field emission cold cathode having a first electrical potential, said gate structure comprising:

a primary gate electrode having a first opening portion surrounding said top of said cathode, said primary gate electrode having a second electrical potential which is higher than said first electrical potential for causing an electron emission from said top of said cathode; and a secondary gate electrode having a second opening portion surrounding said primary gate electrode, said secondary gate electrode being spaced apart from said primary gate electrode in a direction perpendicular to a traveling direction along which electrons emitted from said top of said cathode travel, said secondary gate electrode having a third electrical potential which is higher than said first electrical potential and lower than said second electrical potential so as to provide a current-voltage characteristic which suppresses said electron emission in a low current region, wherein a second voltage comprising a difference between said first and third electrical potentials varies in proportion to a first voltage comprising a difference between said first and second electrical potentials so that said current-voltage characteristic has an apparent gamma-property.

8. The gate structure as claimed in claim 7, wherein said first opening portion of said primary gate electrode is smaller than said second opening portion of said secondary gate electrode.

9. The gate structure as claimed in claim 7, wherein said primary and secondary gate electrodes are separated by an insulation film.

10. The gate structure as claimed in claim 7, wherein said primary and secondary gate electrodes are separated by space.

11. The gate structure as claimed in claim 7, wherein said cathode has a cone shape with a top pointed.

12. The gate structure as claimed in claim 7, further comprising:

at least a ternary gate electrode having a third opening portion and being spaced apart from said primary gate electrode in a direction parallel to said traveling direction, said ternary gate electrode having a fourth electrical potential which is higher than said first electrical potential and lower than said, second electrical potential so as to provide, in cooperation with said secondary gate electrode, said current-voltage characteristic which suppresses said electron emission particularly in a low current region.

13. An electron gun comprising:

a substrate;

a field emission cold cathode being provided on said substrate, said field emission cold cathode having a first electrical potential;

a primary gate electrode being spaced apart from said substrate in a direction parallel to a traveling direction along which electrons emitted from said top of said cathode travel, said primary gate electrode having a first opening portion surrounding said top of said cathode, said primary gate electrode having a second electrical potential which is higher than said first electrical potential for causing an electron emission from said top of said cathode;

at least a secondary gate electrode having a second opening portion and being spaced apart from said primary gate electrode in a direction parallel to said traveling direction, said secondary gate electrode having a third electrical potential which is higher than said first electrical potential and lower than said second electrical potential so as to provide a current-voltage characteristic which suppresses said electron emission in a low current region, wherein a second voltage comprising a difference between said first and third electrical potentials varies in proportion to a first voltage comprising a difference between said first and second electrical potentials so that said current-voltage characteristic has an apparent gamma-property; and an anode electrode being spaced apart from said primary and secondary gate electrodes in a direction parallel to said traveling direction so that electrons emitted from said cathode travel toward said anode electrode.

14. The electron gun as claimed in claim 13, wherein said primary gate electrode is separated from said substrate through a first insulation film having an opening portion which surrounds said cathode.

15. The electron gun as claimed in claim 13, wherein said primary and secondary gate electrodes are separated by a second insulation film.

16. The electron gun as claimed in claim 13, wherein said primary and secondary gate electrodes are separated by space.

17. The electron gun as claimed in claim 13, wherein said first opening portion of said primary gate electrode is smaller than said second opening portion of said secondary gate electrode.

18. The electron gun as claimed in claim 13, wherein said cathode has a cone shape with a top pointed.

19. The electron gun as claimed in claim 13, further comprising:

a ternary gate electrode having a third opening portion surrounding said primary gate electrode, said ternary gate electrode being spaced apart from said primary gate electrode in a direction perpendicular to said traveling direction, said ternary gate electrode having a fourth electrical potential which is higher than said first electrical potential and lower than said second electrical potential so as to provide, in cooperation with said secondary gate electrode, a current-voltage characteristic which suppresses said electron emission in a low current region.

20. An electron gun comprising:

a substrate;

a field emission cold cathode being provided on said substrate, said field emission cold cathode having a first electrical potential;

a primary gate electrode being spaced apart from said substrate in a direction parallel to a traveling direction along which electrons emitted from said top of said cathode travel, said primary gate electrode having a first opening portion surrounding said top of said cathode, said primary gate electrode having a second electrical potential which is higher than said first electrical potential for causing an electron emission from said top of said cathode;

a secondary gate electrode being spaced apart from said primary gate electrode in a direction perpendicular to said traveling direction, said secondary gate electrode having a second opening portion surrounding said primary gate electrode, said secondary gate electrode having a third electrical potential which is higher than said first electrical potential and lower than said second electrical potential so as to provide a current-voltage characteristic which suppresses said electron emission in a low current region, wherein a second voltage comprising a difference between said first and third electrical potentials varies in proportion to a first voltage comprising a difference between said first and second electrical potentials so that said current-voltage characteristic has an apparent gamma-property; and an anode electrode being spaced apart from said primary and secondary gate electrodes in a direction parallel to said traveling direction so that electrons emitted from said cathode travel toward said anode electrode.

21. The electron gun as claimed in claim 20, wherein said primary and secondary gate electrodes are separated from said substrate through a first insulation film having an opening portion which surrounds said cathode and said primary and secondary gate electrodes are separated by space.

22. The electron gun as claimed in claim 20, wherein said first opening portion of said primary gate electrode is smaller than said second opening portion of said secondary gate electrode.

23. The electron gun as claimed in claim 20, wherein said cathode has a cone shape with a top pointed.

24. The electron gun as claimed in claim 20, further comprising:

at least a ternary gate electrode having a third opening portion and being spaced apart from said primary gate electrode in a direction parallel to said traveling direction, said ternary gate electrode having a fourth electrical potential which is higher than said first electrical potential and lower than said second electrical potential so as to provide, in cooperation with said secondary gate electrode, said current-voltage characteristic which suppresses said electron emission in a low current region.

* * * * *